US010450809B2

(12) United States Patent
Hefner et al.

(10) Patent No.: US 10,450,809 B2
(45) Date of Patent: Oct. 22, 2019

(54) PIPE CLEANING SYSTEM AND METHOD

(71) Applicants: Steve Hefner, Borger, TX (US); Deborah Hefner, Borger, TX (US)

(72) Inventors: Steve Hefner, Borger, TX (US); Deborah Hefner, Borger, TX (US)

( * ) Notice: Subject to any disclaimer, the term of this patent is extended or adjusted under 35 U.S.C. 154(b) by 344 days.

(21) Appl. No.: 14/993,561

(22) Filed: Jan. 12, 2016

(65) Prior Publication Data

US 2016/0121375 A1 May 5, 2016

Related U.S. Application Data

(63) Continuation-in-part of application No. 13/802,696, filed on Mar. 13, 2013, now Pat. No. 9,404,313.

(51) Int. Cl.

| | |
|---|---|
| ***B08B 9/023*** | (2006.01) |
| ***E21B 33/08*** | (2006.01) |
| ***E21B 17/00*** | (2006.01) |
| ***B08B 1/00*** | (2006.01) |
| ***B08B 1/02*** | (2006.01) |
| ***E21B 23/04*** | (2006.01) |
| ***E21B 17/07*** | (2006.01) |
| ***E21B 10/28*** | (2006.01) |
| ***E21B 44/02*** | (2006.01) |

(52) U.S. Cl.

CPC ..... *E21B 17/006* (2013.01); *B08B 1/005* (2013.01); *B08B 1/008* (2013.01); *B08B 1/02* (2013.01); *B08B 9/023* (2013.01); *E21B 33/08* (2013.01); *E21B 10/28* (2013.01); *E21B 17/076* (2013.01); *E21B 23/04* (2013.01); *E21B 44/02* (2013.01)

(58) Field of Classification Search

CPC ..... E21B 37/00; E21B 17/006; E21B 33/08; B08B 9/023

See application file for complete search history.

(56) References Cited

U.S. PATENT DOCUMENTS

| | | | | |
|---|---|---|---|---|
| 3,820,184 | A | 6/1974 | Stone | |
| 4,205,694 | A | 6/1980 | Thompson | |
| 4,517,699 | A | 5/1985 | Petricka | |
| 4,723,564 | A | 2/1988 | West | |
| 5,069,234 | A | 12/1991 | Nielsen | |
| 5,085,016 | A * | 2/1992 | Rose | B08B 9/023 118/305 |
| 5,101,896 | A | 4/1992 | Thompson | |
| 5,136,969 | A | 8/1992 | Chapman | |
| 5,191,740 | A | 3/1993 | Rose | |
| 5,361,791 | A | 11/1994 | Chapman | |
| 5,615,696 | A | 4/1997 | Lawler | |
| 5,647,906 | A | 7/1997 | Monday | |
| 5,802,667 | A | 9/1998 | Williams | |
| 5,946,757 | A | 9/1999 | Oliveira | |
| 6,941,613 | B2 | 9/2005 | Bryant | |
| 7,294,222 | B2 | 11/2007 | Temple | |

(Continued)

*Primary Examiner* — David J Bagnell
*Assistant Examiner* — Manuel C Portocarrero
(74) *Attorney, Agent, or Firm* — Shannon Warren

(57) ABSTRACT

A containment head comprises a center aperture, a reservoir, a wiping rubber, an outer body, a bottom plate and a support cylinder. The center aperture comprises a central portion of the containment head configured to pass around a tubing. The reservoir comprises a space within the outer body and above the bottom plate. The containment head is configured to selectively attach to a tubing cleaning assembly.

14 Claims, 15 Drawing Sheets

(56) References Cited

U.S. PATENT DOCUMENTS

| | | | | |
|---|---|---|---|---|
| 7,409,995 | B2 | 8/2008 | Moynahan | |
| 7,765,632 | B2 | 8/2010 | Lawler | |
| 9,415,426 | B1 * | 8/2016 | Blake | B08B 9/023 |
| 2012/0305234 | A1 * | 12/2012 | Vowels | E21B 37/00 166/90.1 |

* cited by examiner

PIPE CLEANING SYSTEM AND METHOD

CROSS-REFERENCE TO RELATED APPLICATIONS

This US utility patent application claims benefit to and is a continuation in part of U.S. application Ser. No. 13/802,696 (filed Mar. 13, 2013). Both applications are filed by the same inventors.

STATEMENT REGARDING FEDERALLY SPONSORED RESEARCH OR DEVELOPMENT (IF APPLICABLE)

Not applicable.

REFERENCE TO SEQUENCE LISTING, A TABLE, OR A COMPUTER PROGRAM LISTING COMPACT DISC APPENDIX (IF APPLICABLE)

Not applicable.

BACKGROUND OF THE INVENTION

None of the known inventions and patents, taken either singularly or in combination, is seen to describe the instant disclosure as claimed.

BRIEF SUMMARY OF THE INVENTION

A containment head and a method of use are disclosed.

Said containment head comprises a center aperture, a reservoir, a wiping rubber, an outer body, a bottom plate and a support cylinder. The center aperture comprises a central portion of the containment head configured to pass around a tubing. The reservoir comprises a space within the outer body and above the bottom plate. The containment head is configured to selectively attach to a tubing cleaning assembly.

The method of using a containment head, comprising: selectively fitting a tubing cleaning assembly around a tubing, removing the tubing from a well bore, spraying a fluid at the tubing as it is extracted through the tubing cleaning assembly, cleaning a portion of the tubing, receiving a portion of a debris which is spilling from the spraying system as it is extracted from the well bore, and collecting the debris in a reservoir within the tubing cleaning assembly. The tubing cleaning assembly comprises a center aperture, the reservoir, a wiping rubber, an outer body, a bottom plate and a support cylinder. The center aperture comprises a central portion of the containment head configured to pass around a tubing. The reservoir comprises a space within the outer body and above the bottom plate. The containment head is configured to selectively attach to a tubing cleaning assembly.

DETAILED DESCRIPTION OF THE INVENTION

Described herein is a tubing cleaning assembly containment head. The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1A:
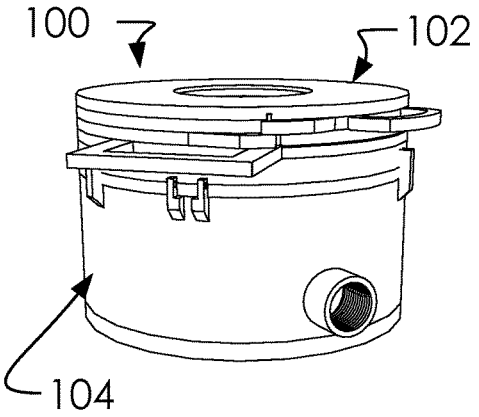
FIGS. 1A, 1B and 1C illustrate two perspective overviews and a cross section view of a tubing cleaning assembly.
Figure 1B:
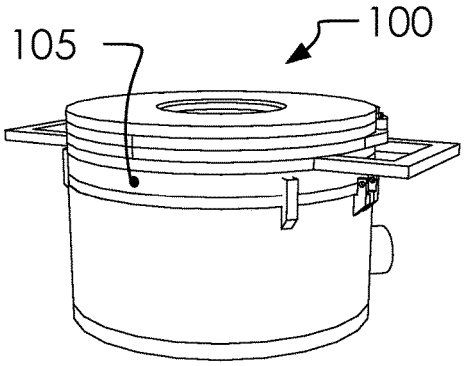
Figure 1C:
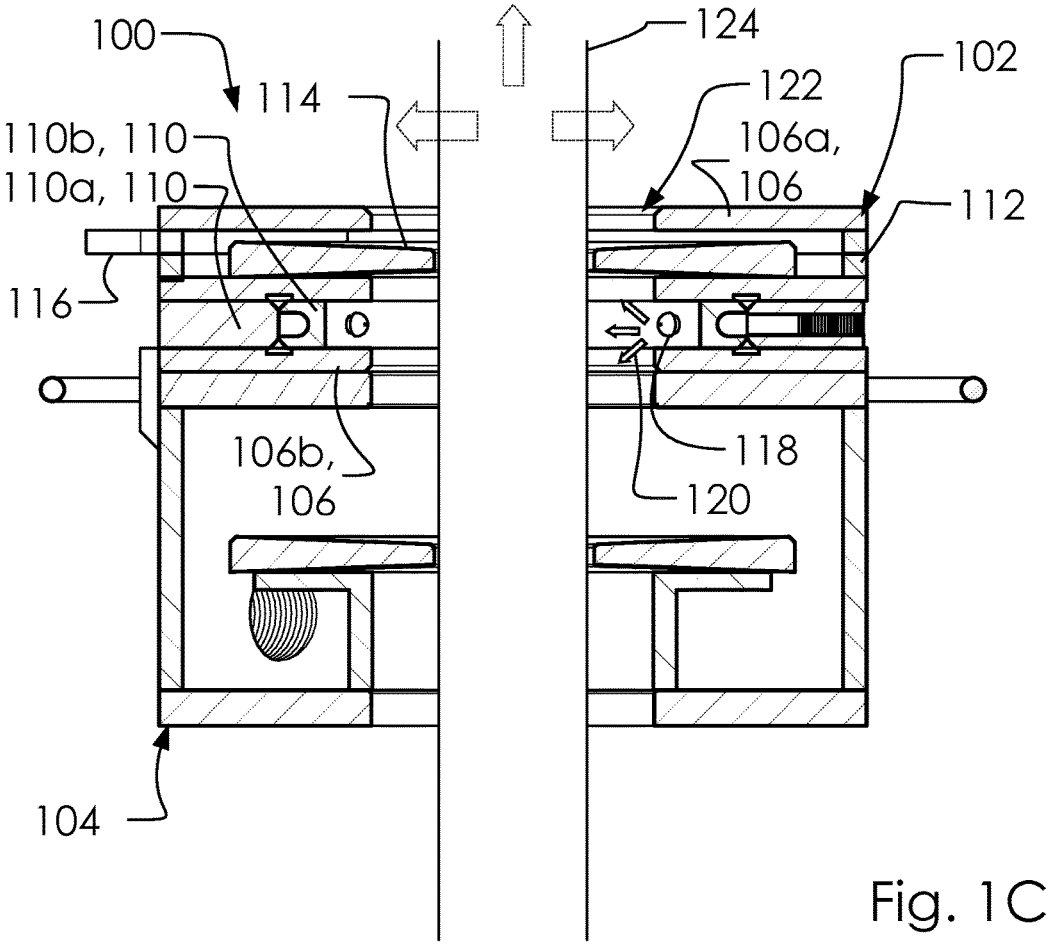

FIGS. 1A, 1B and 1C illustrate two perspective overviews and a cross section view of a tubing cleaning assembly 100.

In one embodiment, said tubing cleaning assembly 100 can comprise a spraying system 102 and a containment head 104. In one embodiment, said tubing cleaning assembly 100 can be used to clean a central aperture 122.

Here said spraying system 102 is introduced in summary but more on this topic can be found in the parent application to this continuation-in-part, namely U.S. patent application Ser. No. 13/802,696. Other examples of technologies similar to said spraying system 102 can be found at US Patent Application Number US20120305234.

In one embodiment, said spraying system 102 can comprise a two or more plates 106, a one or more handles 602, a one or more pressure rings 110, and a spacer assembly 112. In one embodiment, said two or more plates 106 can comprise a first outer plate 102 and a second outer plate 104. In one embodiment, a handle plate 106 can comprise of said one or more handles 602. In one embodiment, said one or more pressure rings 110 can comprise a first outer plate 106*a* and a second outer plate 106*b*. In one embodiment, said spraying system 102 can comprise a spray heads 118 that are operable for dispensing a sprayed fluid 120. In one embodiment, said tubing cleaning assembly 100 can have a wiping rubber 114. In one embodiment, aforementioned components of said spraying system 102 can comprise a central aperture 122. In one embodiment, said central aperture 122 can accommodate a tubing 124.

In one embodiment, said wiping rubber 114 can comprise a central aperture 126 having an internal diameter being substantially the same as an external diameter of said tubing 124; accordingly, said wiping rubber 114 can be configured to permitting said tubing 124 to slide through said spraying system 102 while wiping material off of said tubing 124. That is, said tubing cleaning assembly 100 can cleanse said tubing 124 as said tubing 124 passes though said central aperture 122.

In one embodiment, said containment head 104 can be located below said spraying system 102 and can hold residue and waste generated by cleaning said tubing 124. In one embodiment, said containment head 104 can be attached to said spraying system 102. In one embodiment, said containment head 104 can be a separate component from said spraying system 102 wherein said spraying system 102 can be used with or without said containment head 104.

Figure 2:
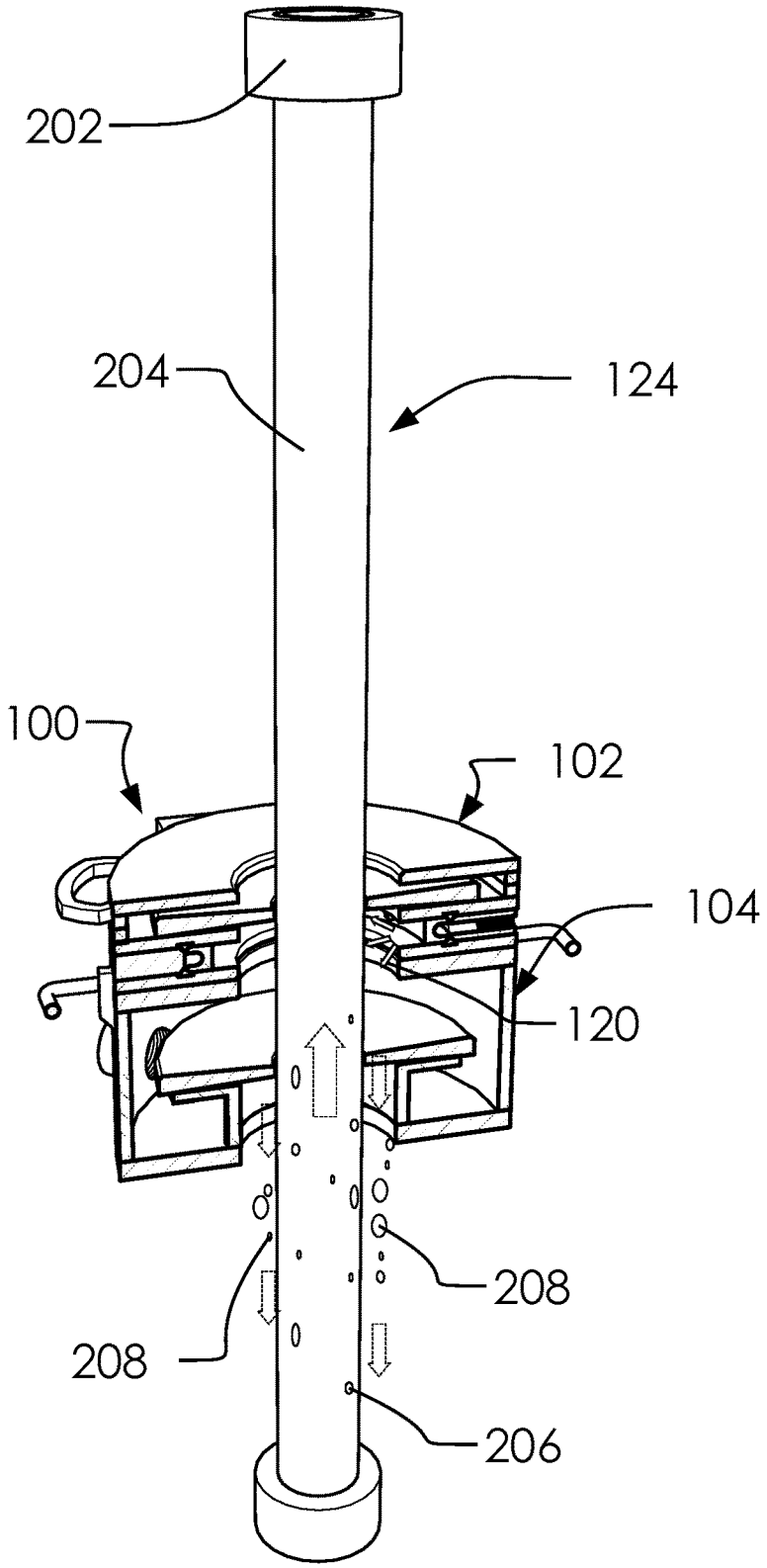
FIG. 2 illustrates a perspective overview of said tubing with said tubing cleaning assembly in cross-section.

FIG. 2 illustrates a perspective overview of said tubing 124 with said tubing cleaning assembly 100 in cross-section.

In one embodiment, said tubing 124 can comprise a one or more collar portions 202 and a body portion 204. In one embodiment (but not in all embodiments), said body portion 204 can comprise a 2⅜" diameter and said one or more collar portions 202 can comprise a 3 1/16" diameter. In another embodiment, said body portion 204 can comprise 2⅞" and/or said tubing 124 can comprise J55 type tubing. In one embodiment, said tubing cleaning assembly 100 can clean said tubing 124 by: spraying a portion of said tubing 124 as it passes through said second outer plate 106*b* with said spray heads 118; and wiping a portion of said tubing 124 with said wiping rubber 114. In one embodiment, said tubing 124 can accumulate a residue 206 while in use. In one embodiment, removing said residue 206 can comprise a useful objective of said tubing cleaning assembly 100 so as prepare said tubing 124 for future use, transport and/or other tasks known in the art. In one embodiment, removing a portion of said residue 206 from said tubing 124 with said tubing cleaning assembly 100 can comprise: spraying said residue 206 with said spray heads 118, wiping said tubing 124 with said wiping rubber 114, releasing a debris 208 below said tubing cleaning assembly 100, and collecting said debris 208 within said containment head 104. In one embodiment, said debris 208 can fall back down said tubing 124 without the use of said containment head 104. In one embodiment, said debris 208 can comprise a portion of said residue 206 and a portion of said sprayed fluid 120.

Figure 3:
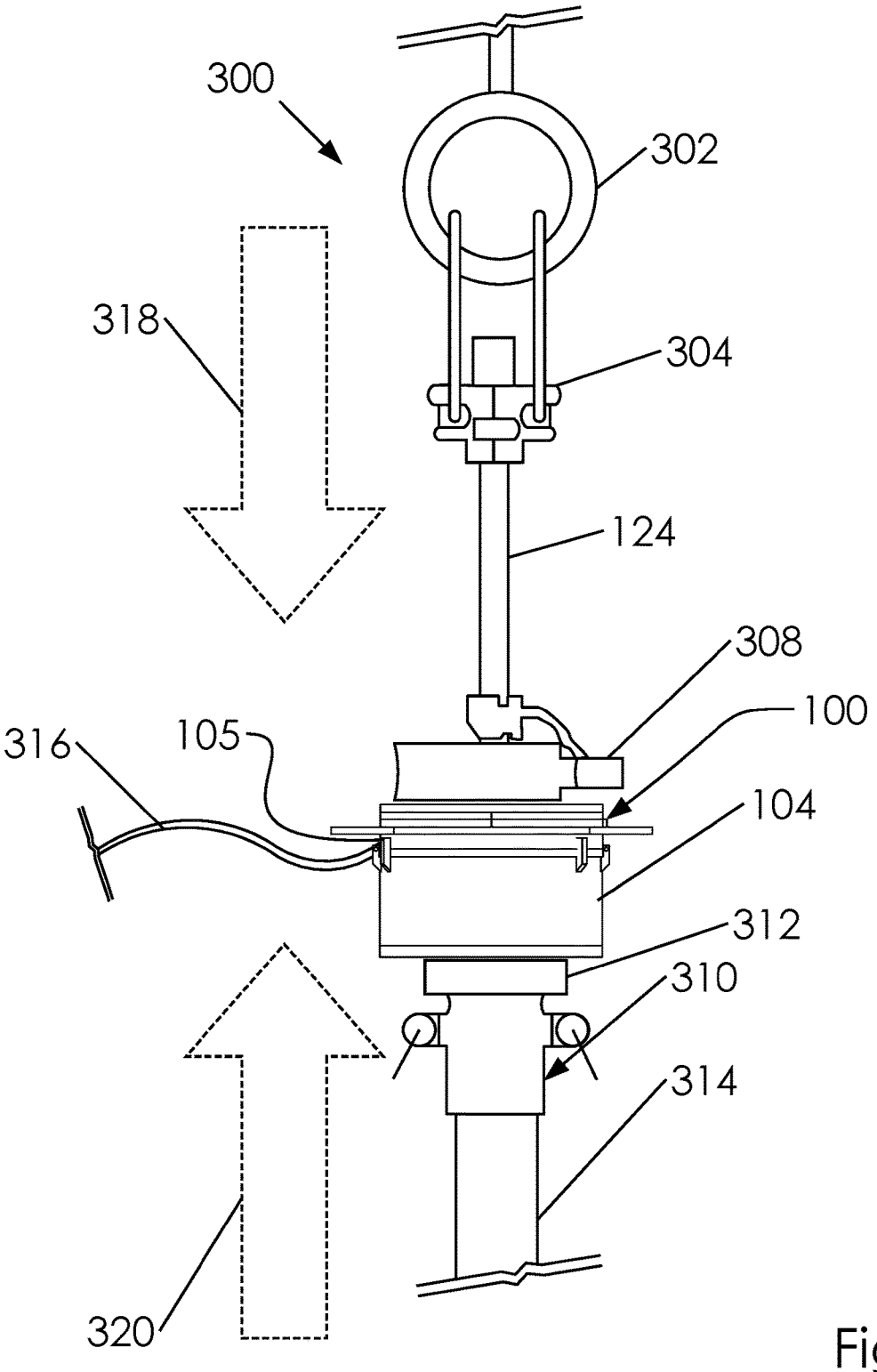
FIG. 3 illustrates an elevated side view of a tubing removal assembly with said tubing cleaning assembly.

FIG. 3 illustrates an elevated side view of a tubing removal assembly 300 with said tubing cleaning assembly 100.

In one embodiment, said tubing removal assembly 300 can comprise a one or more blocks 302, a one or more elevators 304, said tubing 124, an air slips 308, a wellhead 310 having a cap 312, and a casing 314. In one embodiment, said tubing cleaning assembly 100 can comprise a hose 316. In one embodiment, said hose 316 is operable to delivering a fluid stream (not pictured) to said tubing cleaning assembly 100. In one embodiment, said hose 316 can attach to said fluid input 105. In one embodiment, using said tubing cleaning assembly 100 and said containment head 104 in said tubing removal assembly 300 can comprise withstanding a one or more forces such as a downward force 318 and an upward force 320. In one embodiment, using said tubing cleaning assembly 100 and said containment head 104 in line with said tubing removal assembly 300 and bearing said one or more forces can comprise a distinctive feature of said tubing cleaning assembly 100 and said containment head 104. In one embodiment, said two or more plates 106 are stacked on one another. In one embodiment, said one or more fluid channels in said two or more plates 106 are protected by said two or more plates 106. In one embodiment, each of said two or more plates 106 are individual and collectively operable for withstanding said downward force 318 and/or said upward force 320.

Figure 4:
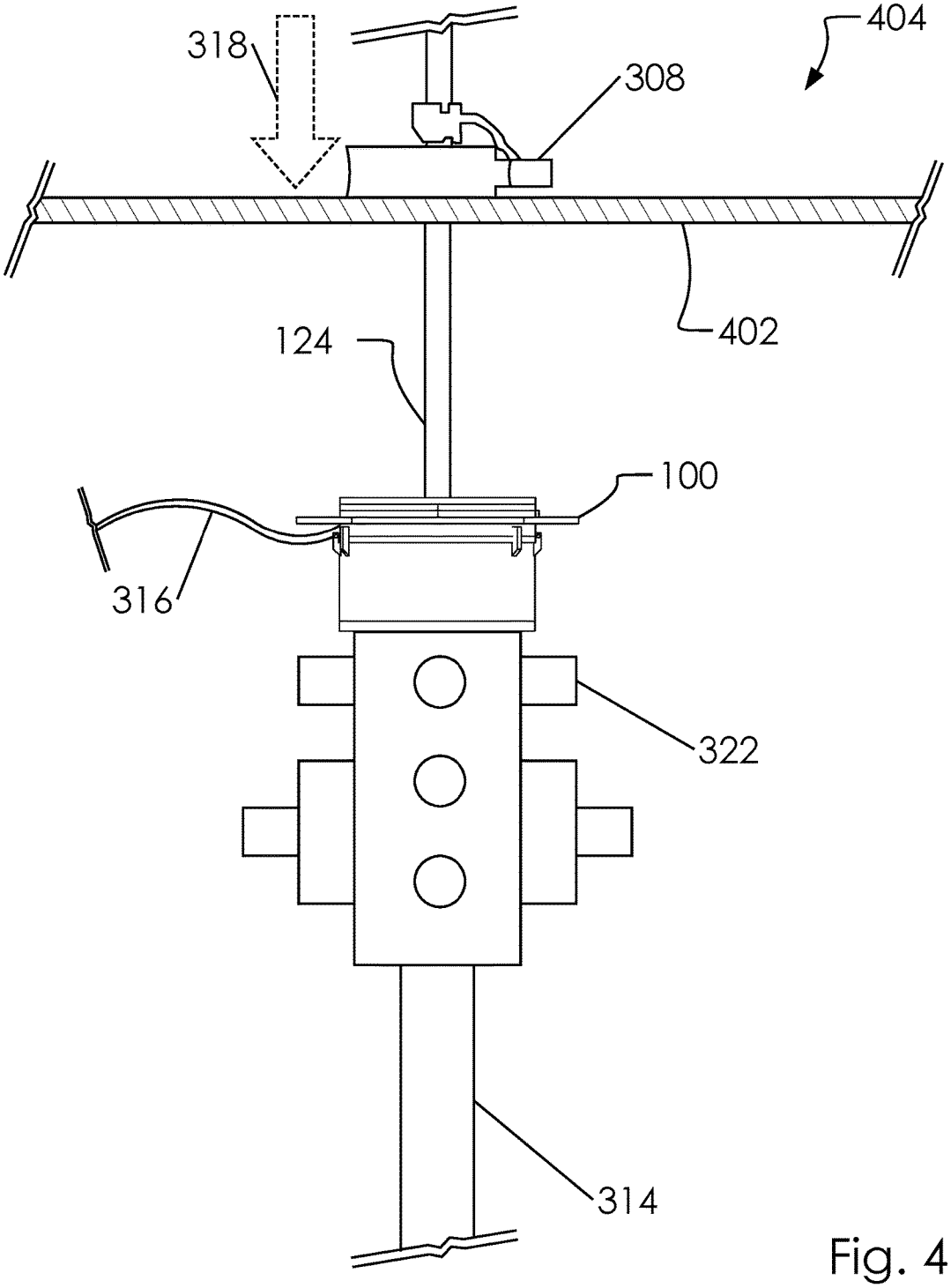
FIG. 4 illustrates an elevated side view of a tubing removal assembly with said tubing cleaning assembly and said containment head.

FIG. 4 illustrates an elevated side view of a tubing removal assembly 404 with said tubing cleaning assembly 100 and said containment head 104.

In one embodiment, said tubing cleaning assembly 100 and said containment head 104 can be used with said tubing removal assembly 404. In one embodiment, said tubing removal assembly 404 can comprise a system for removing said tubing 124 from said casing 314 with the added benefit of a blowout preventer 322 and a substructure 324; wherein, a portion of said downward force 318 can be isolated and held up by said substructure 324. In one embodiment, said containment head 104 can attach between said tubing cleaning assembly 100 and said blowout preventer 322 wherein the latter is attached on top of said wellhead 310. Thus, in one embodiment, said tubing cleaning assembly 100 can be used with or without said upward force 320 and downward force 318 pressed into itself.

Figure 5:
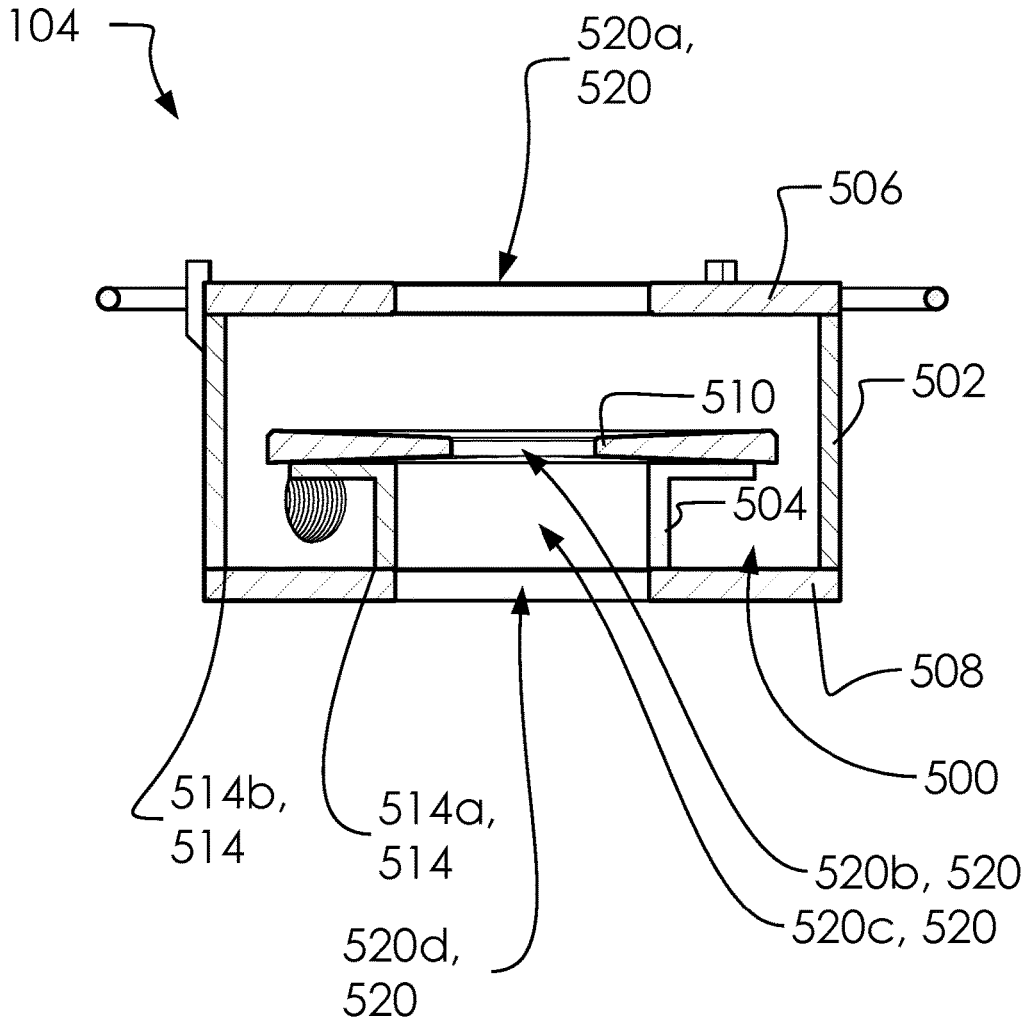
FIG. 5 illustrates a cross-section side view of said containment head with a reservoir.

FIG. 5 illustrates a cross-section side view of said containment head 104 with a reservoir 500.

In one embodiment, said containment head 104 can comprise a two or more plates 106, a center aperture 520, a one or more wiping rubbers, a one or more waste apertures, an outer body 502, and a support cylinder 504. In one embodiment, said support cylinder 504 can comprise a cylinder aperture 520*c*. In one embodiment, said two or more plates 106 can comprise a top plate 506 and a bottom plate 508. In one embodiment, said top plate 506 can have a top aperture 520*a* while said bottom plate 508 can have a lower aperture 520*d*. In one embodiment, said containment head 104 can be used without said top plate 506 if said containment head 104 is attached permanently to said tubing cleaning assembly 100 (embodiment not shown). In one embodiment, said one or more wiping rubbers can comprise a wiping rubber 510 similar to said wiping rubber 114. In one embodiment, said wiping rubber 510 can have an plate aperture 520*b*.

In one embodiment, the center of said top aperture 520*a*, said plate aperture 520*b*, said cylinder aperture 520*c*, and said lower aperture 520*d* can line up to accommodate said tubing 124. In one embodiment, said outer body 502, said support cylinder 504, and said bottom plate 508 can attach together via a one or more welding beads 514 to serve as said reservoir 500 for solids and liquids. Said one or more welding beads 514 can comprise of a first welding bead 514*a* to attach said support cylinder 504 to said bottom plate 508, and a second welding bead 514*b* to attach said outer body 502 to said bottom plate 508. In one embodiment, said waste aperture 706 can be threaded so that an external hose or tube can be connected to draw waste away from said reservoir 500.

Said reservoir 500 within said containment head 104 primarily stores and removes said residue 206 and said debris 208 from said tubing 124 and said tubing cleaning assembly 100. In one embodiment, while said reservoir 500 is formed from a sum of components including said top plate 506, said outer body 502, said bottom plate 508, and said support cylinder 504, all but said top plate 506 are not removable from said containment head 104.

Figure 6A:
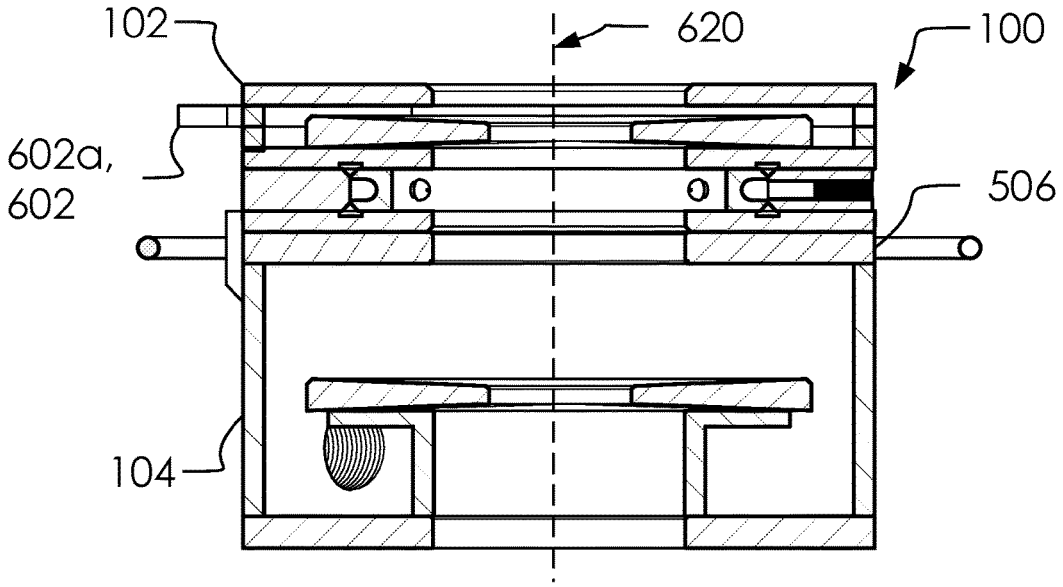
FIGS. 6A and 6B illustrate a cross-section elevated side view of said tubing cleaning assembly with and without said top plate, respectively.
Figure 6B:
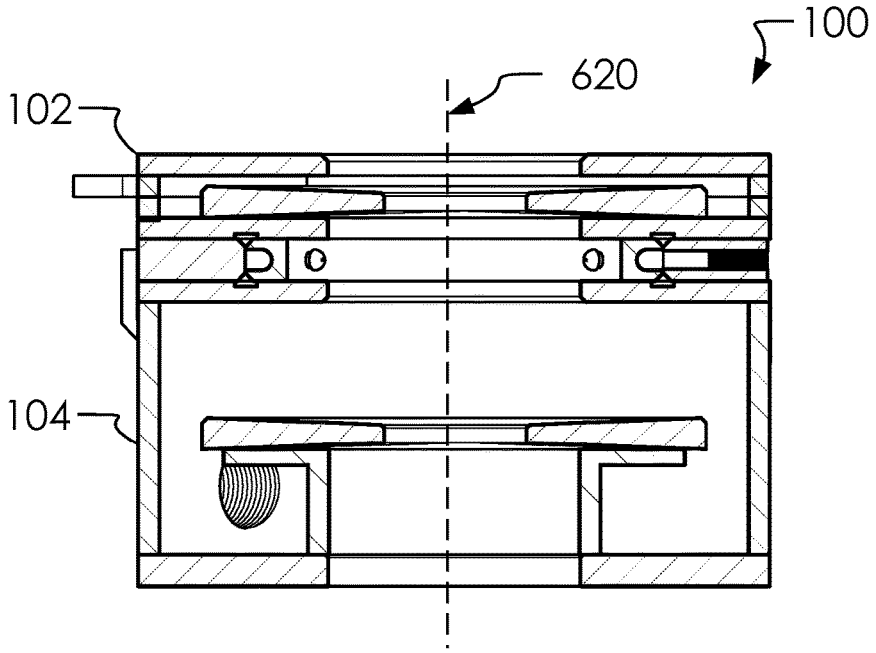

FIGS. 6A and 6B illustrate a cross-section elevated side view of said tubing cleaning assembly 100 with and without said top plate 506, respectively.

As stated previously, said tubing cleaning assembly 100 can comprise a two or more plates 106, a one or more handles 602, a one or more pressure rings 110, and a spacer assembly 112. In one embodiment, said spraying system 102 can comprise a one or more handles 602 which can comprise a first handle 602*a* and a second handle 602*b*.

In one embodiment, said tubing cleaning assembly 100 can be used with or without said top plate 506. In one embodiment, said top plate 506 can be used to seal off said containment head 104 and in another embodiment, said containment head 104 can be sealed off with a lower portion of said spraying system 102, as illustrated in FIG. 6A.

Said center aperture comprises an opening about a center axis 620 of said tubing cleaning assembly 100.

Figure 7:
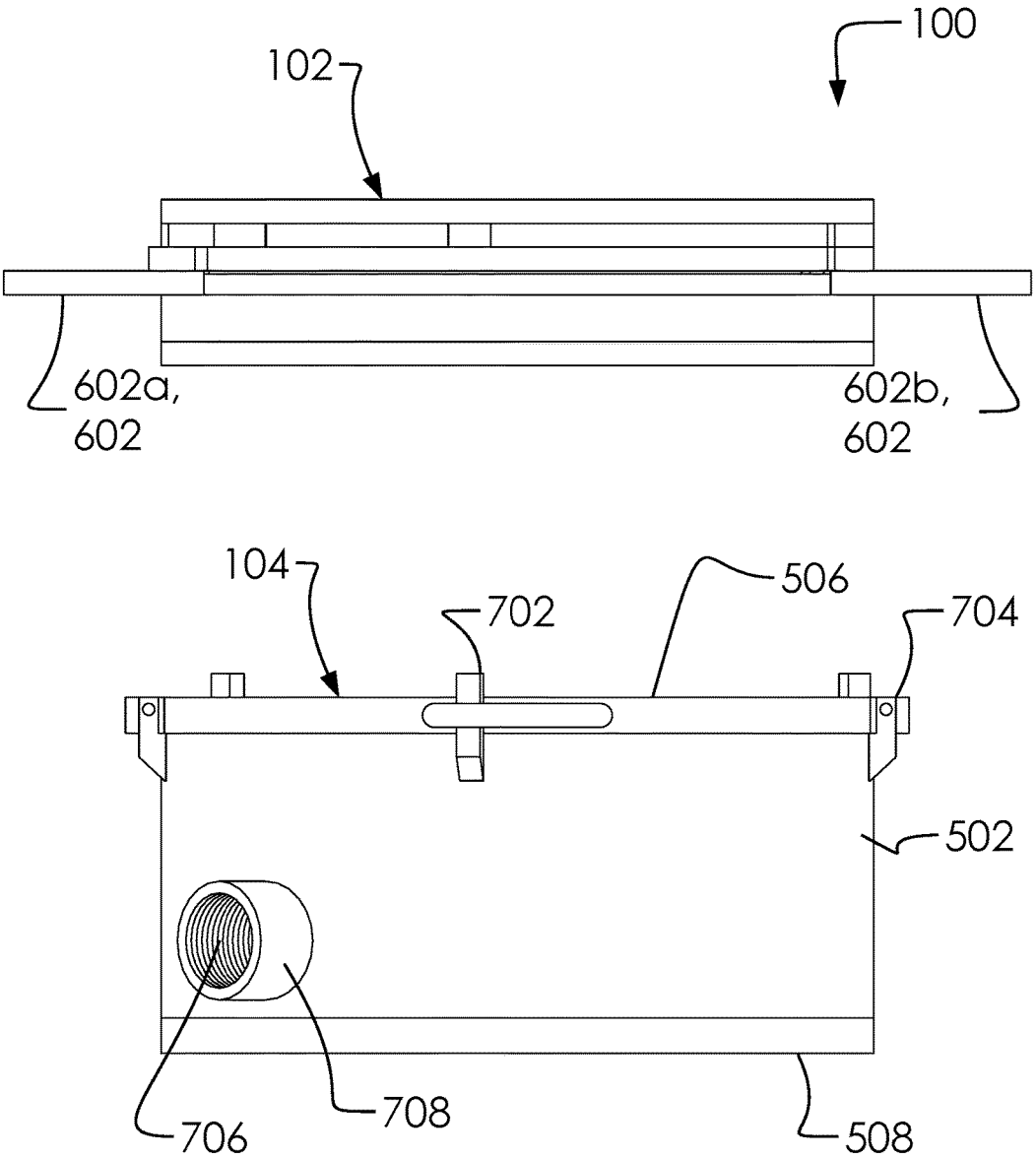
FIG. 7 illustrates an elevated front view of said tubing cleaning assembly with said spraying system and said containment head exploded from one another.

FIG. 7 illustrates an elevated front view of said tubing cleaning assembly 100 with said spraying system 102 and said containment head 104 exploded from one another.

In one embodiment, said containment head 104 can further comprise a one or more top plate guide 702 and a one or more mechanical fastener 704. Said one or more top plate guide 702 provides aligned placement of said top plate 506 on said outer body 502; that is, said one or more top plate guide 702 is helpful in limiting movement of said top plate 506 when placed on said outer body 502.

In one embodiment, said top plate 506 can be guided into place by said one or more top plate guide 702 and fastened onto said outer body 502 by said one or more mechanical fastener 704. In one embodiment, where said containment head 104 is used without said top plate 506, said one or more mechanical fastener 704 can attach to a portion of said spraying system 102. In one embodiment, said support cylinder 504 can comprise of a one or more components held together by said first welding bead 514*a* (see infra). In one embodiment, said support cylinder 504 and said bottom plate 508 can be held together by said second welding bead 514*b*. In one embodiment, said bottom plate 508 and said outer body 502 can be held together by said third welding bead 514*c*.

In one embodiment, said outer body 502 can comprise a waste aperture 706 with a waste collar 708. In one embodiment, said reservoir 500 can be evacuated using said waste aperture 706 at said waste collar 708.

Figure 8:
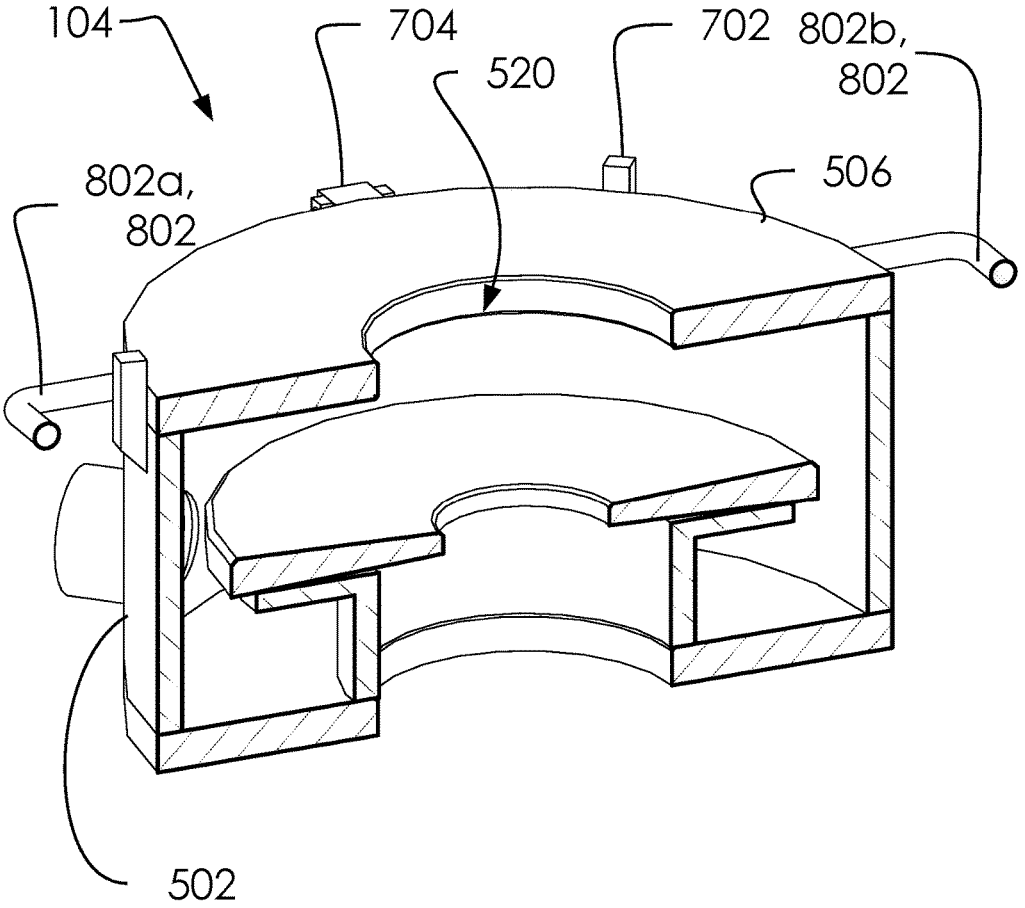
FIG. 8 illustrates a cross-section perspective overview of said containment head.

FIG. 8 illustrates a cross-section perspective overview of said containment head 104.

In one embodiment, said top plate 506 can comprise a one or more handles 802 which can comprise a first handle 802*a* and a second handle 802*b*.

Figure 9:
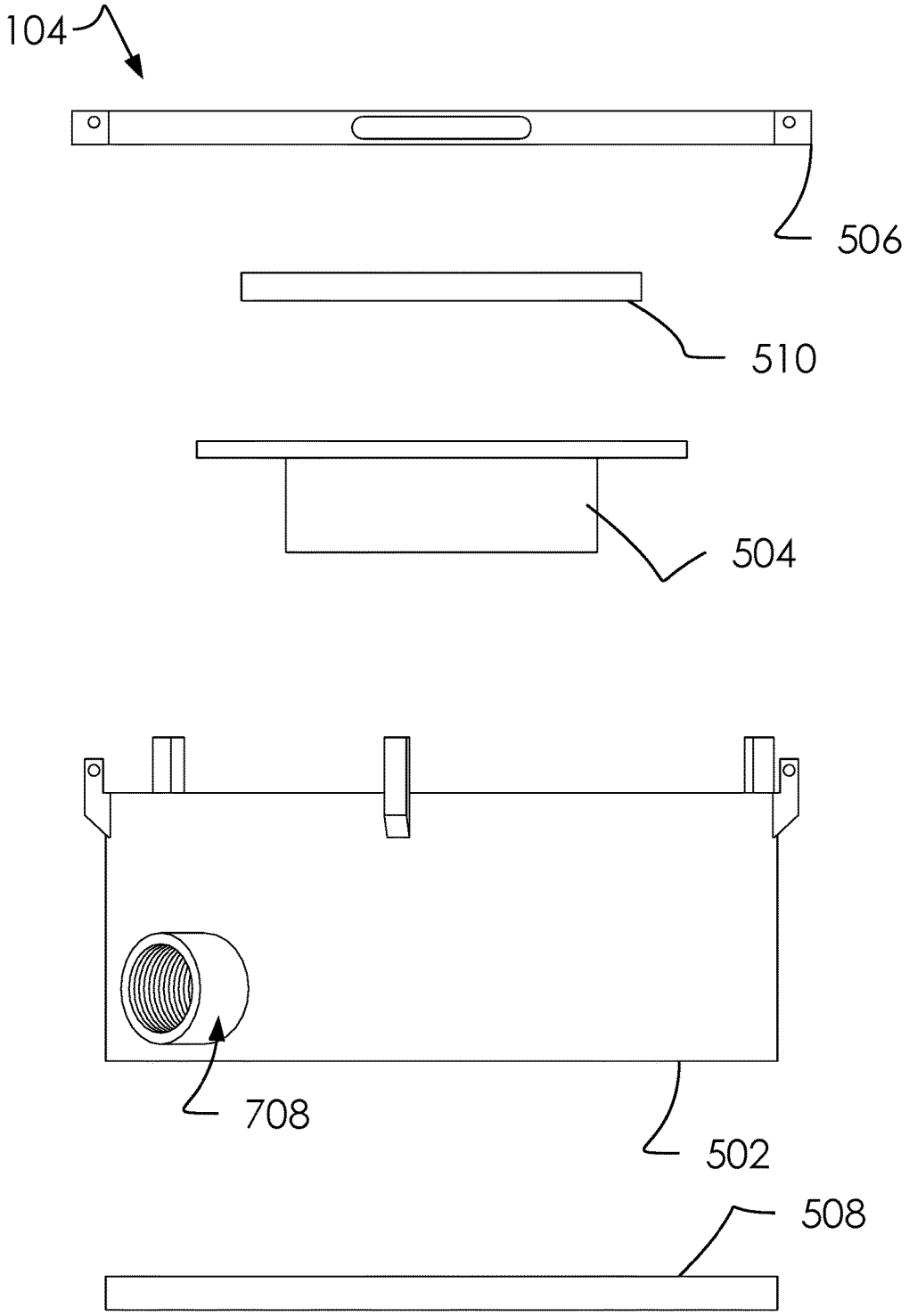
FIG. 9 illustrates an exploded side view of said containment head.

FIG. 9 illustrates an exploded side view of said containment head 104.

In one embodiment, said bottom plate 508 forms the base of said containment head 104 while said outer body 502 serves as the side. In one embodiment, said support cylinder 504 attaches to said bottom plate 508 within the center cavity of said outer body 502. Said wiping rubber 510 rests on top of said support cylinder 504 and said top plate 506 can be fastened on said outer body 502 to complete said containment head 104 and form said reservoir 500.

Figure 10A:
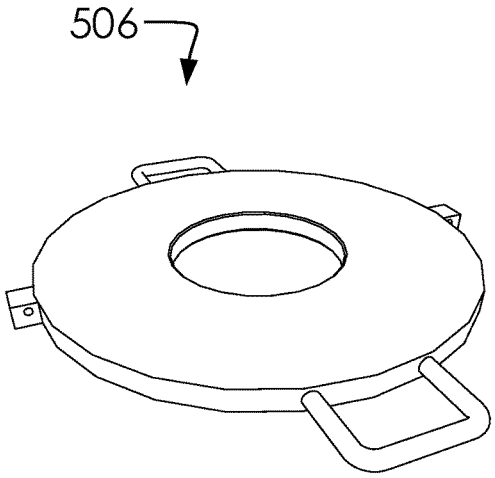
FIGS. 10A, 10B, and 10C illustrate a perspective overview, a top view, and a side view, respectively, of said top plate.
Figure 10B:
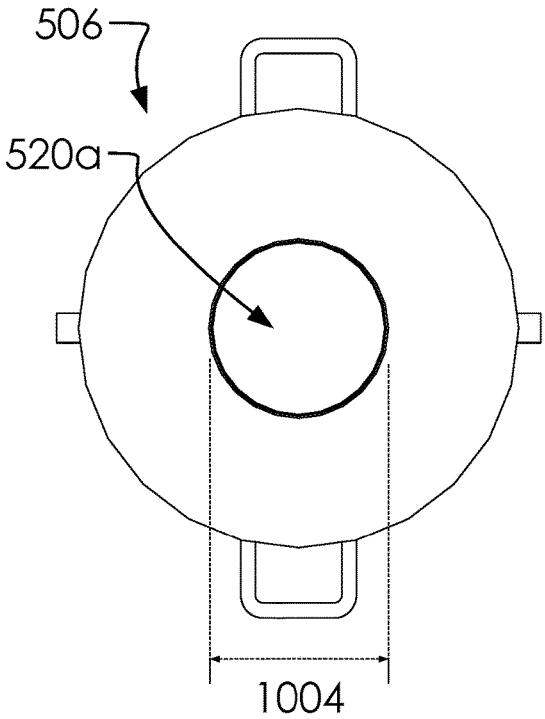
Figure 10C:
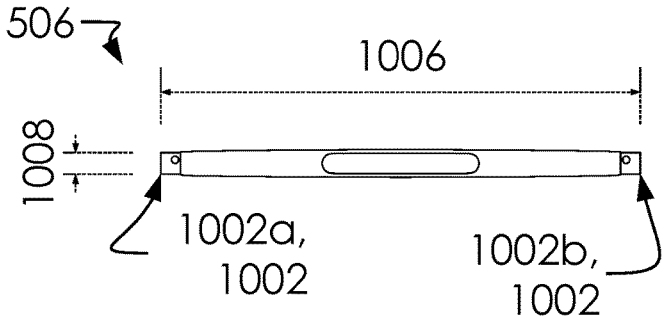

FIGS. 10A, 10B, and 10C illustrate a perspective overview, a top view, and a side view, respectively, of said top plate 506.

In one embodiment, said top plate 506 can comprise a ¾ inch thick steel plate having a substantially circular shape. In one embodiment, said top plate 506 can have said top aperture 520*a*. In one embodiment, said top plate 506 can have an internal diameter 1004, an external diameter 1006, and a height 1008; wherein said height 1008 can be ¾ inches. In one embodiment, said top plate 506 can comprise of said external diameter 1006 measuring 15 inches and said internal diameter 1004 measuring 6 inches. In one embodiment, said top plate 506 can comprise a one or more attachments along said external diameter 1006. In one embodiment, said one or more attachments can comprise a one or more latch posts 1002 for moving said top plate 506; wherein, said one or more latch posts 1002 can comprise a first latch post 1002*a* and a second latch post 1002*b*.

Figure 11A:
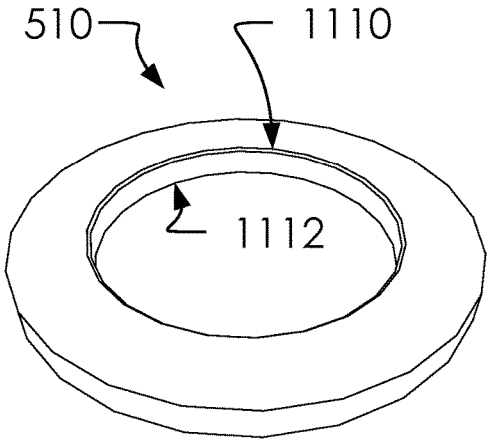
FIGS. 11A, 11B, and 11C illustrate a perspective overview, a top view, and a side view of said wiping rubber.
Figure 11B:
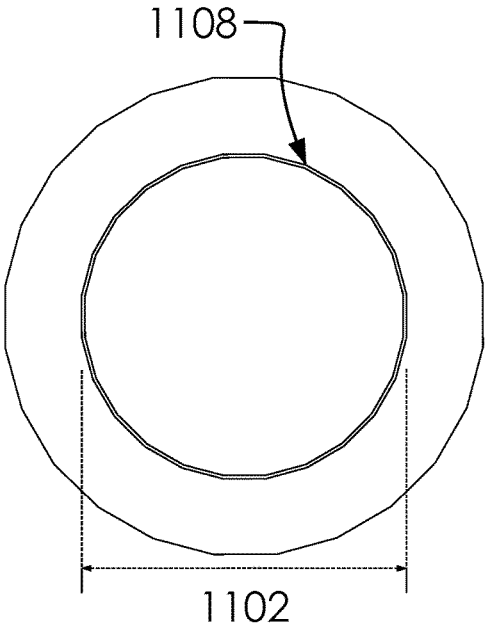
Figure 11C:
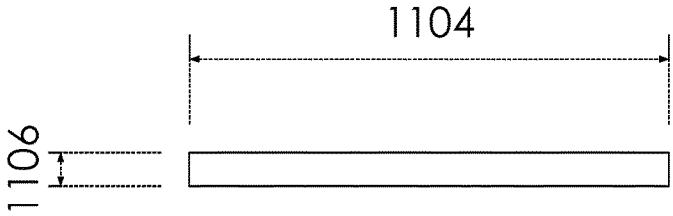

FIGS. 11A, 11B, and 11C illustrate a perspective overview, a top view, and a side view of said wiping rubber 510.

In one embodiment, said wiping rubber 510 can have a thickness 1106 of ½ inch. In one embodiment, said thickness 1106 can vary. In one embodiment, said wiping rubber 510 can have an outer diameter 1104 and an inner diameter 1102. In one embodiment, said outer diameter 1104 can be 8 inches and said inner diameter 1102 can be 6 inches. In one embodiment, said outer diameter 1104 and said inner diameter 1102 can vary.

In one embodiment, said wiping rubber 510 can comprise a beveled edge 1108 along said inner diameter 1102. In one embodiment, said beveled edge 1108 can be on a top edge 1110 and/or a bottom edge 1112.

Figure 12A:
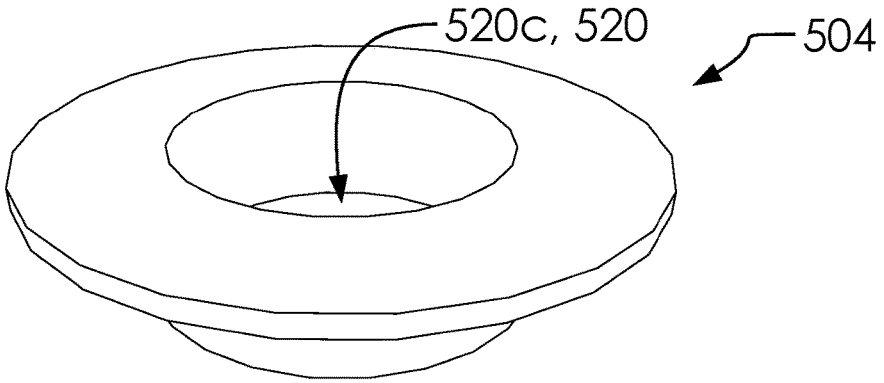
FIGS. 12A, 12B and 12C illustrate a perspective overview, a side view, and a wireframe view, respectively, of said support cylinder.
Figure 12B:
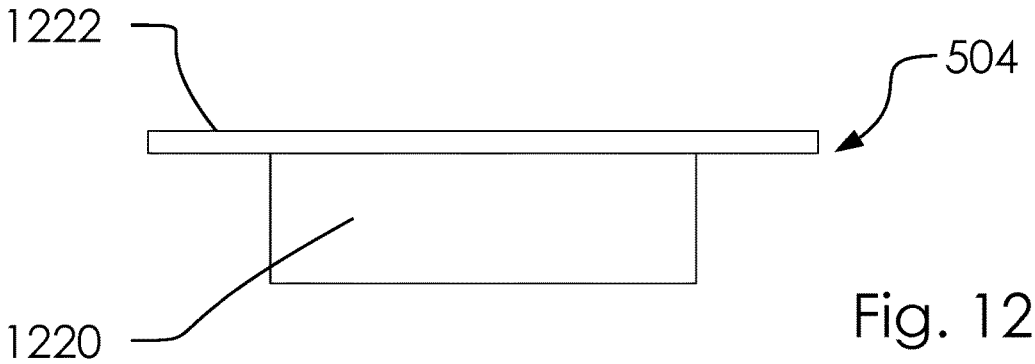
Figure 12C:
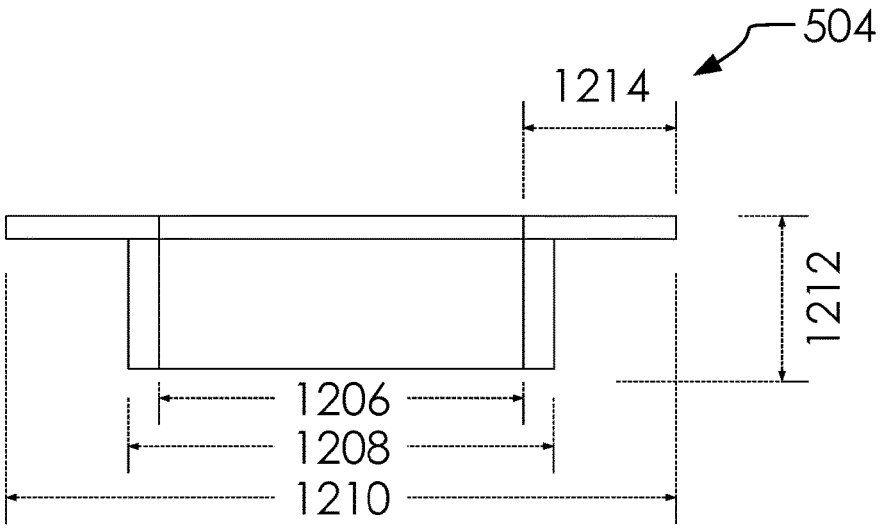

FIGS. 12A, 12B and 12C illustrate a perspective overview, a side view, and a wireframe view, respectively, of said support cylinder 504.

In one embodiment, said support cylinder 504 can comprise an inner diameter 1206, a lower outer diameter 1208, an upper outer diameter 1210, and a height 1212, and have a plate width 1214 to support said wiping rubber 510. In one embodiment, said inner diameter 1206 can be 6 inches and said height 1212 can be 2½ inches. In one embodiment, said inner diameter 1206, said lower outer diameter 1208, said upper outer diameter 101, and said height 1212 can vary to accommodate different sized wiping rubbers and larger or smaller containment heads. In one embodiment, said support cylinder 504 provides a rigid structure for said wiping rubber 510 while said downward force 318 is applied.

In one embodiment, said support cylinder 504 can comprise a cylinder portion 1220 and a platform portion 1222. In one embodiment, said cylinder portion 1220 and said platform portion 1222 can be welded together or otherwise constructed out of one piece of material. In one embodiment, said cylinder portion 1220 can comprise a cylindrical element configured to lift said platform portion 1222 above said bottom plate 508 and to create said reservoir 500, as illustrated above.

Figure 13A:
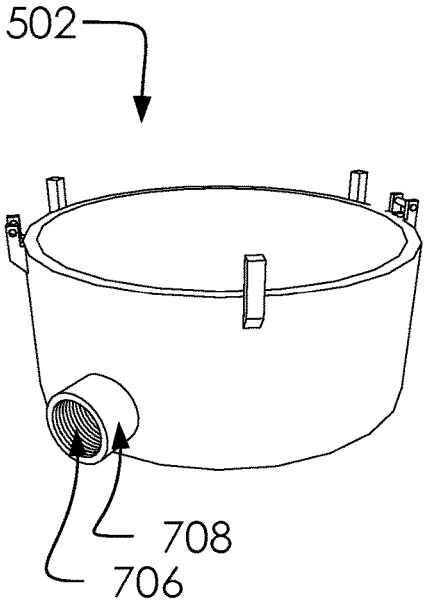
FIGS. 13A, 13B, and 13C illustrate a perspective overview, a top view, and a side view of said outer body.
Figure 13B:
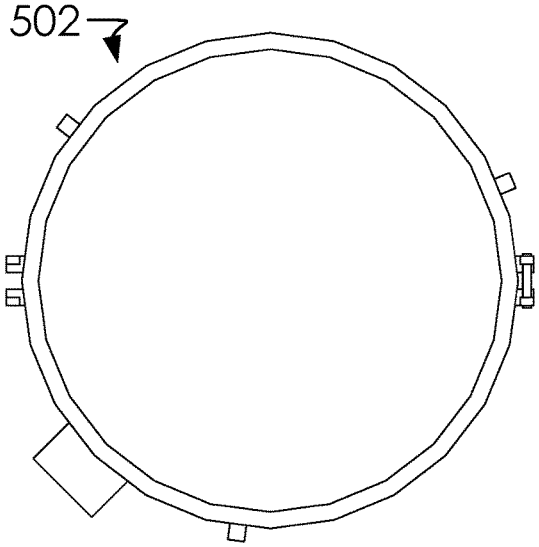
Figure 13C:
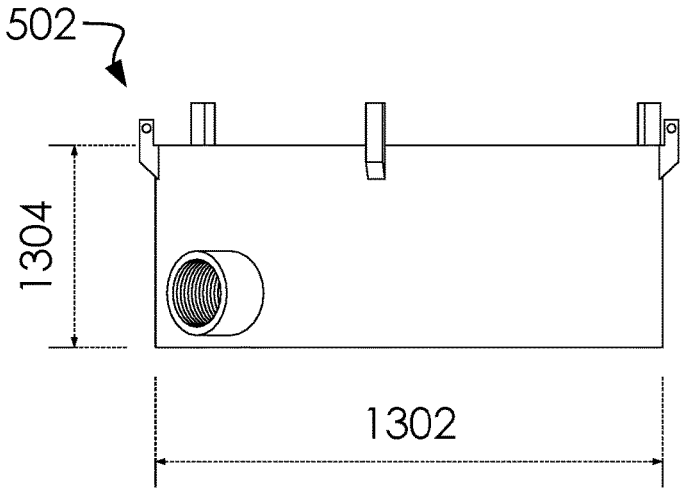

FIGS. 13A, 13B, and 13C illustrate a perspective overview, a top view, and a side view of said outer body 502.

In one embodiment, said outer body 502 can have a diameter 1302 and a height 1304. In one embodiment, said diameter 1302 can be 15 inches. In one embodiment, said waste collar 708 provides an extended outlet away from said outer body 502. In one embodiment, said waste aperture 706 can comprise an inner threading. In one embodiment, said waste aperture 706 can be used to attach an external hose or pathway (not illustrated here).

Figure 14A:
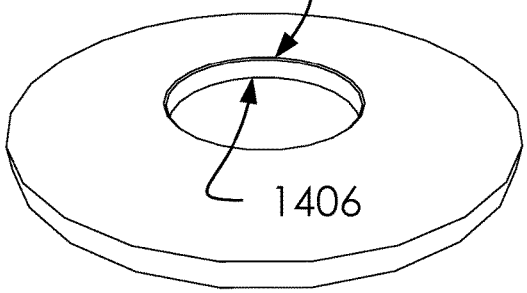
FIGS. 14A, 14B, and 14C illustrate a perspective overview, a top view, and a side view of said bottom plate.
Figure 14B:
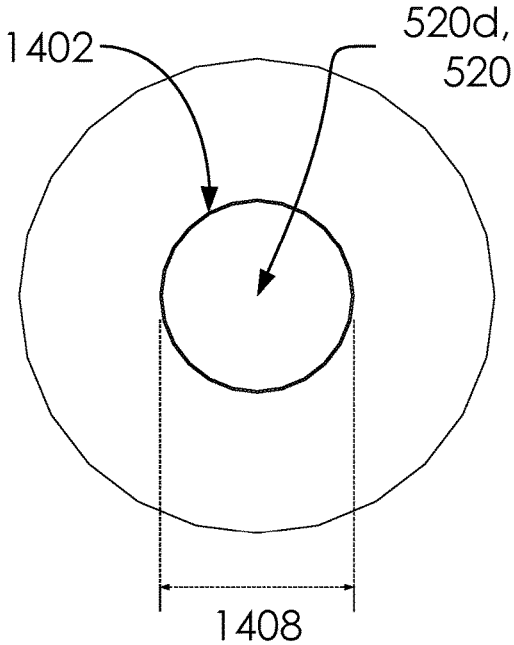
Figure 14C:
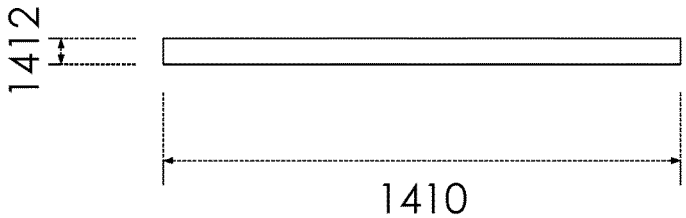

FIGS. 14A, 14B, and 14C illustrate a perspective overview, a top view, and a side view of said bottom plate 508.

In one embodiment, said bottom plate 508 can be welded onto the bottom of said outer body 502 to form the external portion of said containment head 104. In one embodiment, said bottom plate 508 can comprise a beveled edge 1402 along a top edge 1404 and a bottom edge 1406. In one embodiment, said bottom plate 508 can comprise an inner diameter 1408, an outer diameter 1410, and a height 1412. In one embodiment, said inner diameter 1408 can be 6 inches and said outer diameter 1410 can be 15 inches. In one embodiment, said inner diameter 1408 and said outer diameter 1410 can vary to fit differing sizes of said outer body 502.

Figure 15A:
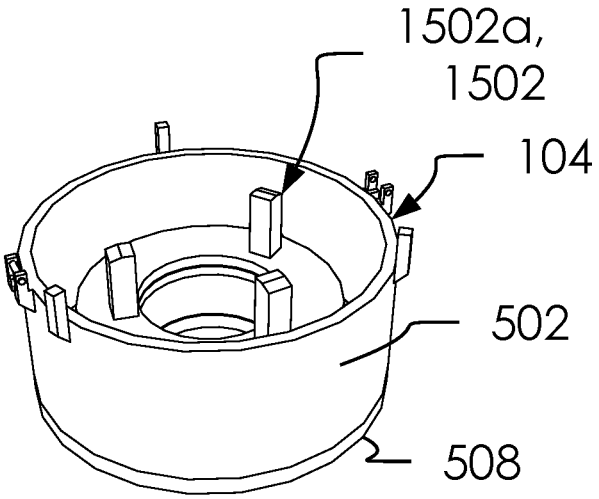
FIGS. 15A and 15B illustrate a perspective overview of two embodiments of said containment head without said top plate.
Figure 15B:
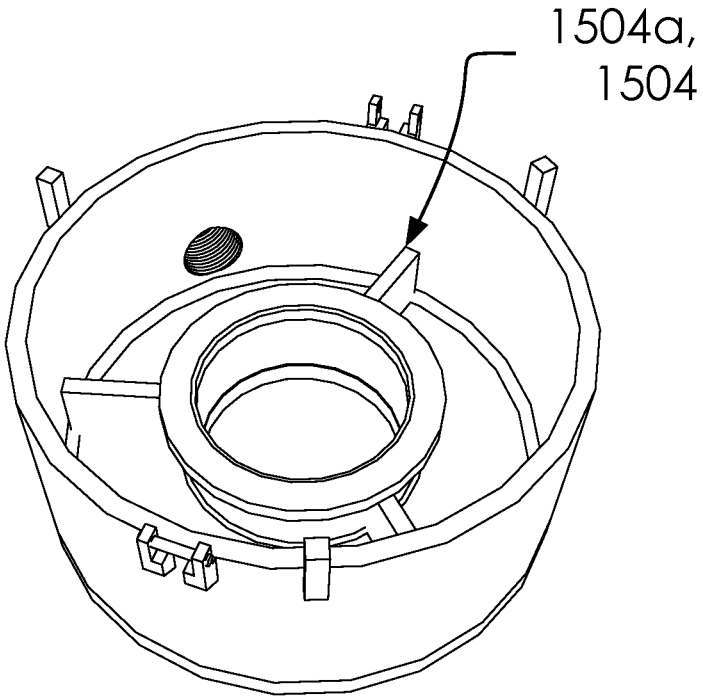

FIGS. 15A and 15B illustrate a perspective overview of two embodiments of said containment head 104 without said top plate 506.

In one embodiment, a one or more spacers 1502 can be used between said top plate 506 and said wiping rubber 510 to keep said wiping rubber 510 pressed against said support cylinder 504. Said one or more spacers 1502 can comprise a first spacer 1502*a*. In one embodiment, said one or more spacers 1502 can be attached to either said wiping rubber 510 or said top plate 506. In one embodiment, said one or more spacers 1502 may be omitted if liquid pressure from said tubing cleaning assembly 100 is great enough to keep said wiping rubber 510 against said support cylinder 504.

In one embodiment, a one or more braces 1504 can be attached to said outer body 502, said bottom plate 508, and said support cylinder 504. Said one or more braces 1504 can comprise a first brace 1504*a*. By utilizing said one or more braces 1504, the weight of said residue 206 and said debris 208 can be distributed throughout said containment head 104 instead of said bottom plate 508 alone. In one embodiment, if weight of said residue 206 and said debris 208 is light enough to not compromise the integrity of said containment head 104, then said one or more braces 1504 may be omitted.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A tubing cleaning assembly, wherein, said tubing cleaning assembly comprises a containment head;

said containment head comprises a center aperture, a reservoir, a wiping rubber, an outer body, a bottom plate and a support cylinder;

said center aperture comprises a central portion of said containment head configured to pass around a tubing;

said reservoir comprises a space within said outer body and above said bottom plate, and between said support cylinder, said bottom plate and said outer body;

said outer body comprises a substantially cylindrical shape;

said bottom plate is attached about a lower portion of said outer body;

said support cylinder comprises a substantially cylindrical shape;

said bottom plate comprises a lower aperture;

said lower aperture and said support cylinder comprise a similar internal diameter;

said support cylinder is centered around and attached above said lower aperture to create a water tight seal between one another;

external diameter of said bottom plate and an external diameter of said outer body are substantially similar;

said outer body is centered around and attached above said bottom plate to create a water tight seal between one another;

said plate aperture, said cylinder aperture and said lower aperture are aligned with one another to allow said tubing to pass through said containment head;

said outer body further comprises a waste aperture;

said waste aperture is configured for draining a debris from said reservoir;

said waste aperture is aligned with a lower portion of said reservoir and below a top portion of said support cylinder;

said tubing cleaning assembly is configured to remove said debris from said tubing, collect a portion of said debris in said reservoir, and drain said portion of said debris from said reservoir through said waste aperture;

said wiping rubber rests above a portion of said support cylinder;

said wiping rubber comprises a plate aperture, said support cylinder comprises a cylinder aperture, and said bottom plate comprises said lower aperture;

said wiping rubber is positioned above said support cylinder and between said tubing and said outer body;

said tubing cleaning assembly comprises a spraying system and said containment head;

said wiping rubber is configured for allowing a portion of said tubing to pass through said plate aperture, receiving a portion of said debris from said spraying system, and diverting said debris between said outer body and said support cylinder into said reservoir; wherein, said spraying system selectively attaches to said containment head;

said wiping rubber is enclosed inside the lower half of said outer body and is not directly coupled to a vertical wall of said outer body.

2. The tubing cleaning assembly of claim 1, wherein:

said wiping rubber comprises an internal diameter approximately equal to an external diameter of said tubing.

3. The tubing cleaning assembly of claim 1, wherein:

said containment head further comprises a top plate;

said top plate comprises a top aperture in said top plate;
said outer body comprises an external diameter;
said top plate comprises an external diameter;
said external diameter of said top plate is equal to or greater than said external diameter of said outer body;
said top plate is selectively attached to said outer body; and
said top aperture allows a portion of said tubing to pass through said top plate.

4. The tubing cleaning assembly of claim 3, wherein:
said tubing cleaning assembly comprises said spraying system and said containment head; and
said containment head selectively attaches to said spraying system with said top plate attached to a lower portion of said spraying system.

5. The tubing cleaning assembly of claim 1 further comprising:
said waste aperture comprises a waste collar adapted to receive a threaded hose.

6. The tubing cleaning assembly of claim 1 further comprising:
said waste aperture is arranged at said lower portion of said outer body proximate to said bottom plate.

7. The tubing cleaning assembly of claim 1 further comprising:
said tubing cleaning assembly comprises said spraying system and said containment head;
said spraying system is permanently attached to said containment head.

8. The tubing cleaning assembly of claim 1 further comprising:
said tubing cleaning assembly comprises said spraying system and said containment head;
said spraying system selectively attaches to said containment head.

9. The tubing cleaning assembly of claim 1 further comprising:
said outer body of said containment head further comprises a mechanical fastener;
said top plate comprises a latch post; and
said top plate releaseably attaches to said outer body with said mechanical fastener and said latch post.

10. The tubing cleaning assembly of claim 1 further comprising:
said top plate further comprises a one or more handles.

11. The tubing cleaning assembly of claim 1 further comprising:
said containment head further comprises a brace arranged between said support cylinder and said outer body and said bottom plate.

12. A method of using a tubing cleaning assembly, comprising:
selectively fitting said tubing cleaning assembly around a tubing,
removing said tubing from a well bore,
spraying a fluid at said tubing with a spraying system as it is extracted through said tubing cleaning assembly,
cleaning a portion of said tubing,
receiving a portion of a debris which is spilling from said spraying system as it is extracted from said well bore,
collecting said debris in a reservoir within a containment head,
draining said debris from a waste aperture from said reservoir;
wherein,
said tubing cleaning assembly comprises said spraying system and said containment head;
said containment head comprises a center aperture, said reservoir, a wiping rubber, an outer body, a bottom plate and a support cylinder;
said center aperture comprises a central portion of said containment head configured to pass around said tubing;
said reservoir comprises a space
within said outer body and above said bottom plate, and between said support cylinder, said bottom plate and said outer body;
said outer body comprises a substantially cylindrical shape;
said bottom plate is attached about a lower portion of said outer body;
said support cylinder comprises a substantially cylindrical shape;
said bottom plate comprises a lower aperture;
said lower aperture and said support cylinder comprise a similar internal diameter;
said support cylinder is centered around and attached above said lower aperture to create a water tight seal between one another;
external diameter of said bottom plate and an external diameter of said outer body are substantially similar;
said outer body is centered around and attached above said bottom plate to create said water tight seal between one another;
said plate aperture, said cylinder aperture and said lower aperture are aligned with one another to allow said tubing to pass through said containment head;
said outer body further comprises said waste aperture;
said waste aperture is configured for draining said debris from said reservoir;
said waste aperture is aligned with a lower portion of said reservoir and below a top portion of said support cylinder;
said tubing cleaning assembly is configured to
remove said debris from said tubing,
collect a portion of said debris in said reservoir, and
drain said portion of said debris from said reservoir through said waste aperture;
said wiping rubber rests above said portion of said support cylinder;
said wiping rubber comprises a plate aperture, said support cylinder comprises said cylinder aperture, and said bottom plate comprises said lower aperture;
said wiping rubber is positioned above said support cylinder and between said tubing and said outer body;
said tubing cleaning assembly comprises said spraying system and said containment head;
said wiping rubber is configured for
allowing said portion of said tubing to pass through said plate aperture,
receiving said portion of said debris from said spraying system, and
diverting said debris between said outer body and said support cylinder into said reservoir; wherein,
said spraying system selectively attaches to said containment head;
said wiping rubber is enclosed inside the lower half of said outer body and is not directly coupled to a vertical wall of said outer body.

13. The tubing cleaning assembly of claim 12, wherein:
said center aperture comprises an opening about a vertical axis of said containment head and is configured for:
allowing said tubing to pass through a lower aperture of said bottom plate, allowing said tubing to pass through a cylinder aperture of said support cylinder, allowing said tubing to pass through said plate aperture of said wiping rubber, allowing said tubing to pass through said outer body and into said spraying system, receiving said debris from said tubing a portion of which has been released by said spraying system, preventing a majority portion of said debris from passing through said bottom plate, and collecting a portion of said debris into said reservoir.

14. The tubing cleaning assembly of claim 12, wherein:

said outer body comprises said substantially cylindrical shape;

said bottom plate is attached about said lower portion of said outer body;

said support cylinder comprises said substantially cylindrical shape;

said bottom plate comprises said lower aperture;

said lower aperture and said support cylinder comprise said similar internal diameter;

said support cylinder is centered around and attached above said lower aperture to create said water tight seal between one another;

external diameter of said bottom plate and said external diameter of said outer body are substantially similar;

said outer body is centered around and attached above said bottom plate to create a water tight seal between one another;

said wiping rubber rests above said portion of said support cylinder;

said wiping rubber comprises said plate aperture, said support cylinder comprises said cylinder aperture, and said bottom plate comprises said lower aperture;

said plate aperture, said cylinder aperture and said lower aperture are aligned with one another to allow said tubing to pass through said containment head;

said wiping rubber is positioned above said support cylinder and between said tubing and said outer body;

said wiping rubber is configured for allowing said portion of said tubing to pass through said plate aperture, receiving said portion of said debris from said spraying system, and diverting said debris between said outer body and said support cylinder into said reservoir.

* * * * *